US007610953B2

(12) United States Patent
Mulder

(10) Patent No.: US 7,610,953 B2
(45) Date of Patent: Nov. 3, 2009

(54) ASSEMBLY OF BAFFLES AND SEALS AND METHOD OF ASSEMBLING A HEAT EXCHANGER

(75) Inventor: Dominicus Fredericus Mulder, Amsterdam (NL)

(73) Assignee: Shell Oil Company, Houston, TX (US)

( * ) Notice: Subject to any disclaimer, the term of this patent is extended or adjusted under 35 U.S.C. 154(b) by 179 days.

(21) Appl. No.: 11/425,781

(22) Filed: Jun. 22, 2006

(65) Prior Publication Data

US 2006/0289153 A1 Dec. 28, 2006

(30) Foreign Application Priority Data

Jun. 23, 2005 (EP) ..... 05105629

(51) Int. Cl.
*F28F 9/22* (2006.01)
*F23L 15/02* (2006.01)

(52) U.S. Cl. ..... 165/160; 165/161

(58) Field of Classification Search ..... 165/9, 165/76, 81–82, 159, 160, 161, 162
See application file for complete search history.

(56) References Cited

U.S. PATENT DOCUMENTS

| | | | | |
|---|---|---|---|---|
| 1,722,109 | A * | 7/1929 | Potter | 165/160 |
| 1,799,471 | A * | 4/1931 | Leach | 165/68 |
| 1,803,034 | A * | 4/1931 | Potter | 165/160 |
| 1,889,156 | A * | 11/1932 | Shepherd et al. | 165/145 |
| 1,955,006 | A | 4/1934 | Mateer et al. | 257/236 |
| 2,424,795 | A * | 7/1947 | Burns | 165/103 |
| 2,498,827 | A * | 2/1950 | Shaw et al. | 165/132 |
| 2,577,832 | A * | 12/1951 | Weiks | 165/160 |
| 2,830,798 | A * | 4/1958 | Andersen | 165/149 |
| 2,839,276 | A * | 6/1958 | Rossi | 165/81 |
| 4,215,745 | A | 8/1980 | Tuckmantel | 165/160 |
| 4,778,005 | A | 10/1988 | Smith | 165/160 |

(Continued)

FOREIGN PATENT DOCUMENTS

WO 2005/015107 2/2005

(Continued)

OTHER PUBLICATIONS

Perry's Chemical Engineers' Handbook, 6th edition, 1984, McGraw-Hill Inc., pge 11-3 to 11-21.

(Continued)

*Primary Examiner*—Tho V Duong
(74) *Attorney, Agent, or Firm*—Charles W. Stewart

(57) ABSTRACT

An assembly of baffles and seals for mounting in a heat exchanger shell, comprising a plurality of longitudinal baffles; a plurality of longitudinal seals for sealingly engaging longitudinal rims of the longitudinal baffles against the heat exchanger shell after mounting, and further a wall member that is arranged to extend between longitudinal seals of adjacent longitudinal baffles so as to form a double wall with the heat exchanger shell after mounting. A method of assembling a heat exchanger, comprising providing a heat exchanger shell and an assembly of baffles and seals according to the invention;

assembling the assembly of baffles and seals outside the heat exchanger shell and introducing the assembled arrangement into the heat exchanger shell so that each wall member forms a double wall with the heat exchanger shell.

11 Claims, 4 Drawing Sheets

U.S. PATENT DOCUMENTS

| | | | | |
|---|---|---|---|---|
| 4,871,014 | A * | 10/1989 | Sulzberger | 165/76 |
| 2003/0173066 | A1 * | 9/2003 | Mulder | 165/157 |
| 2005/0161204 | A1 * | 7/2005 | Johnston et al. | 165/162 |

FOREIGN PATENT DOCUMENTS

| | | |
|---|---|---|
| WO | 2005/015108 | 2/2005 |
| WO | 2005/067170 | 7/2005 |

OTHER PUBLICATIONS

European Search Report dated Aug. 12, 2005 for European Patent Application 05105629.9.

* cited by examiner 6
26
14
11a
16
12a
11b
27
15
12b
21
17
1
7
22
4

ASSEMBLY OF BAFFLES AND SEALS AND METHOD OF ASSEMBLING A HEAT EXCHANGER

This application claims the benefit of European Application 05105629.9 filed Jun. 23, 2005.

FIELD OF THE INVENTION

The present invention relates to an assembly of baffles and seals and to its use in a method of assembling a heat exchanger.

BACKGROUND OF THE INVENTION

A shell-and-tube heat exchanger is an indirect heat exchanger. Heat is transferred between a fluid passing through the tubes of a tube bundle (the tube side) extending in the heat exchanger shell, and a fluid passing through the space outside the tubes (the shell side). Details of the shell-and-tube heat exchangers can for example be found in Perry's Chemical Engineers' Handbook, $6^{th}$ edition, 1984, McGraw-Hill Inc., page 11-3 to 11-21.

A particular type of heat-exchanger known as two-shell-pass heat exchanger has been developed for improved transfer of heat in a given shell size. In this type of heat exchanger a generally cylindrical outer tube is provided internally with an axially and longitudinally extending partition baffle. Such shell types include the two-pass shell with longitudinal baffle, the split-flow shell, and the double split-flow shell in Perry's. The longitudinal baffle subdivides the interior of the shell into two separate longitudinally extending compartments that normally communicate at one end of the shell, so that the fluid flow in the shell passes twice along the length of the shell.

For most efficient heat exchange the baffle should form a relatively tight seal along both of its longitudinal rims so that flow between the compartments is only possible in the intended regions, that is at the end or ends of the shell.

Typically, such a structure has been formed by using a rectangular partition plate having a width slightly smaller than the internal diameter of the wall of the shell so that the longitudinal outer rims of this plate are spaced slightly radially inwardly from the inner wall surface of the shell, when the plate is positioned on a diametral plane.

Several types of longitudinal seals have been developed in the past. Except for sufficient sealing, it is also desired that a longitudinal seal allows easy mounting in a heat exchanger shell, and is cost-efficient. A good compromise has for example been found in the baffle seal profiles developed and marketed under the name T4 by Kempchen & Co. GmbH of Oberhausen, Germany. Principles of these seals are also described in USA patent specification No. 4215745, which also discusses other prior art seals.

The known longitudinal seals comprise a U-shaped flange that faces inwardly into the heat exchanger and that is sized to snugly receive the longitudinal baffle. A sealing member at the opposite side of the seal comprises an outwardly extending pair of flanges that elastically presses against the inner wall of the shell.

In many cases a two-shell-pass heat exchanger is not an optimal arrangement. For example, when an existing single pass heat exchanger is to be retrofitted with new internals, the positions of the fluid inlet and outlets of the shell are located at opposite ends longitudinally along the heat exchanger shell, and that can normally not be changed. For a two-pass arrangement, however, shell inlet and outlet should be arranged at the same longitudinal end of the shell.

A three-shell-pass arrangement, in which two longitudinal baffles are arranged so that the fluid flow in the shell meanders three times back and forth the length of the shell, would solve this problem. However, there is considerable hesitation against installation of such a layout, because the design will only realize its high heat-exchange capacity if the longitudinal seals are reliable enough to prevent fluid leakage between passes in the shell side. Although the Kempchen seals are good, they cannot guarantee that leakage is prevented.

SUMMARY OF THE INVENTION

It is an object of the present invention to provide an arrangement of longitudinal baffles and seals that allows improved sealing in multi-shell-pass heat exchangers, in particular also for retrofitting heat exchangers.

It is a further object to provide a method of assembling a heat exchanger with two or more longitudinal baffles.

To this end the present invention provides an assembly of baffles and seals for mounting in a heat exchanger shell, which assembly comprises a plurality of longitudinal baffles each having two longitudinal rims; a plurality of longitudinal seals for sealingly engaging the longitudinal rims of the longitudinal baffles against the heat exchanger shell after mounting, wherein the assembly further comprises a wall member that is arranged to extend between longitudinal seals of adjacent longitudinal baffles so as to form a double wall with the heat exchanger shell after mounting.

The invention further provides a method of assembling a heat exchanger, the method comprising providing a heat exchanger shell;

providing an assembly of baffles and seals comprising a plurality of longitudinal baffles each having two longitudinal rims; a plurality of longitudinal seals; and a plurality of wall members;

assembling the assembly of baffles and seals outside the heat exchanger shell so that an arrangement of stacked longitudinal baffles provided with longitudinal seals at their longitudinal rims is obtained, wherein the wall members extend between longitudinal seals of adjacent longitudinal baffles; and introducing the arrangement into the heat exchanger shell so that each wall member forms a double wall with the heat exchanger shell.

DETAILED DESCRIPTION

Figure 1:
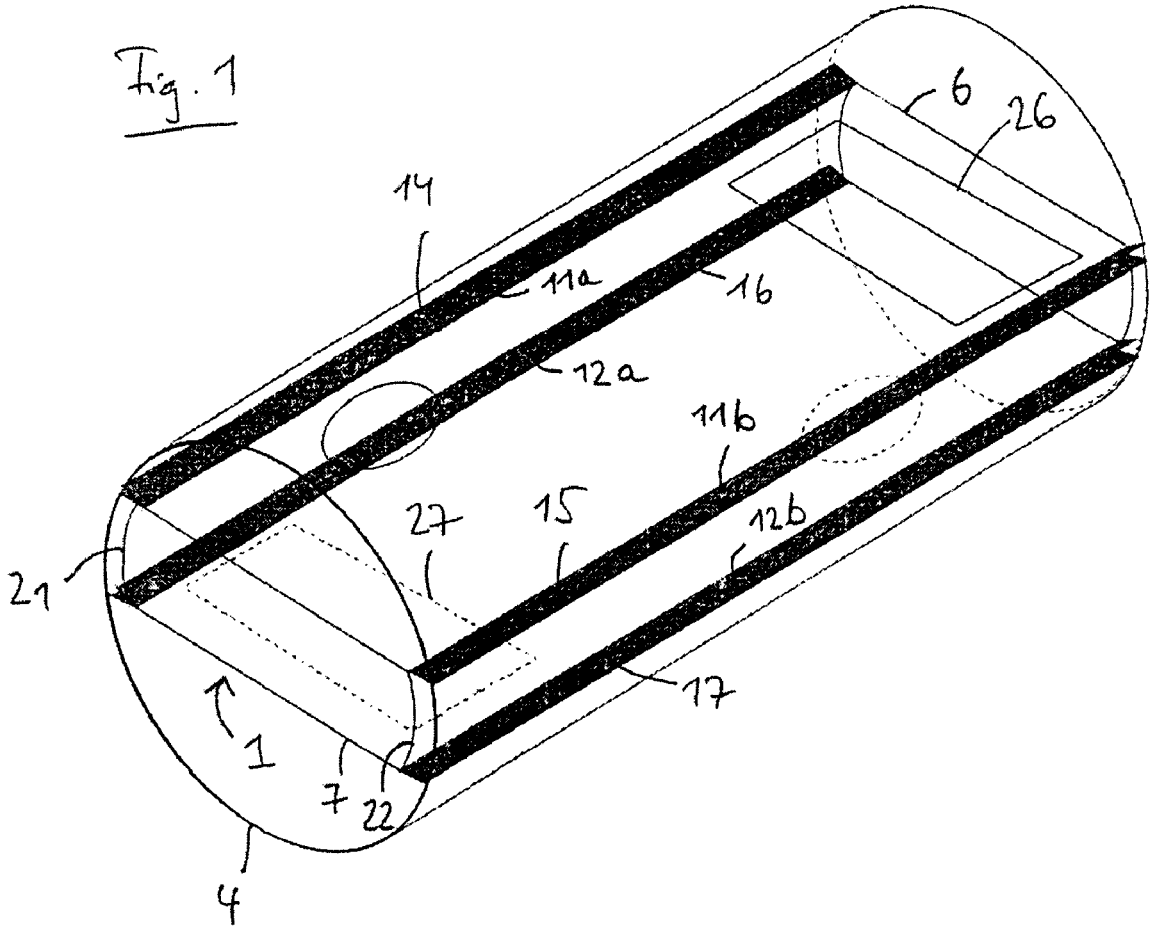
FIG. 1 shows schematically an assembly of baffles and seals according to the invention.

Applicant has realized that the reliability of the seals can be significantly improved if a wall member is provided that forms a double wall with the heat exchanger shell. If then during normal operation fluid from one compartment were to leak along a longitudinal seal, the fluid will enter into the inner space of the double wall, and therefore not directly into another compartment. In order to leak into a further compartment the fluid would need to leak through yet another longitudinal seal. The wall member acts as a leakage barrier.

Suitably, the longitudinal seal comprises a U-shaped flange for receiving the longitudinal rims, and further a wall sealing member. The wall sealing member is suitably formed of oppositely outwardly extending elastic flanges. A suitable such longitudinal seal is the baffle seal T4 of Kempchen & Co. GmbH.

Suitably, the wall member has a folded longitudinal rim, preferably both longitudinal rims are folded. Then the U-shaped flange can be arranged to receive the folded longitudinal rim of the or each wall member extending from that longitudinal seal, in addition to the longitudinal rim of the longitudinal baffle. Preferably the U-shaped flange has a width that is chosen such that the total thickness of longitudinal rims of the longitudinal baffle and the wall member(s) is snugly received.

In special embodiments the longitudinal baffle can be provided with folded longitudinal rims. This may be of advantage if the baffle is to be placed relatively far away from a diametrical plane of a cylindrical shell, since in that case the baffle forms a finite angle with the normal of the shell at the location of the longitudinal seal. By folding the longitudinal rims, that angle can be brought to, or closer to, 0 degrees.

Suitably, the assembly further comprises a plurality of transverse baffles for supporting a bundle of tubes. The transverse baffles can comprise elements of expanded metal, as described in International patent applications No. WO/2005/067170; WO/2005/015107; WO/2005/015108, which are incorporated by reference.

Alternatively the invention can also be used with other types of heat exchangers having a longitudinal flow pattern, examples are heat exchangers with rod baffle tube supports, or heat exchangers with twisted tubes.

When the assembly with n−1 longitudinal baffles is arranged to form a meandering fluid flow path of n passes between an inlet and an outlet after mounting in the heat exchanger shell, wherein n>2, the transverse baffles are suitably formed of n segments. The segments of transverse baffles between adjacent longitudinal baffles then suitably have a cross-section corresponding to the cross-section between opposing double walls of the adjacent longitudinal baffles.

In a special embodiment tubes extend from a tube sheet through the transverse baffles and an transverse end baffle to a tube end sheet, and the wall members are connected at one end to the tube sheet and at the other end to the end baffle. Preferably then the end baffle is provided with a seal so as to prevent bypass of fluid between shell passes around the end baffle.

The assembly can be prefabricated, optionally together with tubesheets and tubes passing through transverse baffles, and slid into the heat exchanger shell, in particular during a replacement operation. It can of course also be mounted directly in a heat exchanger shell.

During a revamp of an existing heat exchanger the step of providing a heat exchanger shell includes removing previous heat exchanger internals from that shell.

The invention will now be described in more detail and with reference to the accompanying drawings. Where the same reference numerals are used in different Figures, they refer to the same or similar objects.

FIG. 1 shows schematically a three-dimensional view of an assembly 1 of baffles and seals according to the present invention. For the sake of clarity part of a heat exchanger shell 4 is indicated around the assembly, but it will be understood that the shell 4 does in general not need to form part of the assembly.

The assembly comprises two longitudinal baffles 6,7 each having a pair of longitudinal rims 11*a,b*;12*a,b*. Further a plurality of longitudinal seals 14,15,16,17 is provided for sealingly engaging the longitudinal rims of the longitudinal baffles against the heat exchanger shell 4 after mounting in the shell. The assembly further comprises wall member 21 that is arranged to extend between the longitudinal seals 14,16 of the adjacent longitudinal baffles 6,7, and wall member 22 that is arranged to extend between the longitudinal seals 15,17 of the longitudinal baffles 6,7. The wall members form a double wall with the heat exchanger shell 4 after mounting. The longitudinal baffles are provided with substantially rectangular cut-outs 26,27, that allow meandering fluid flow between the three compartments that are formed in a shell.

Figure 2:
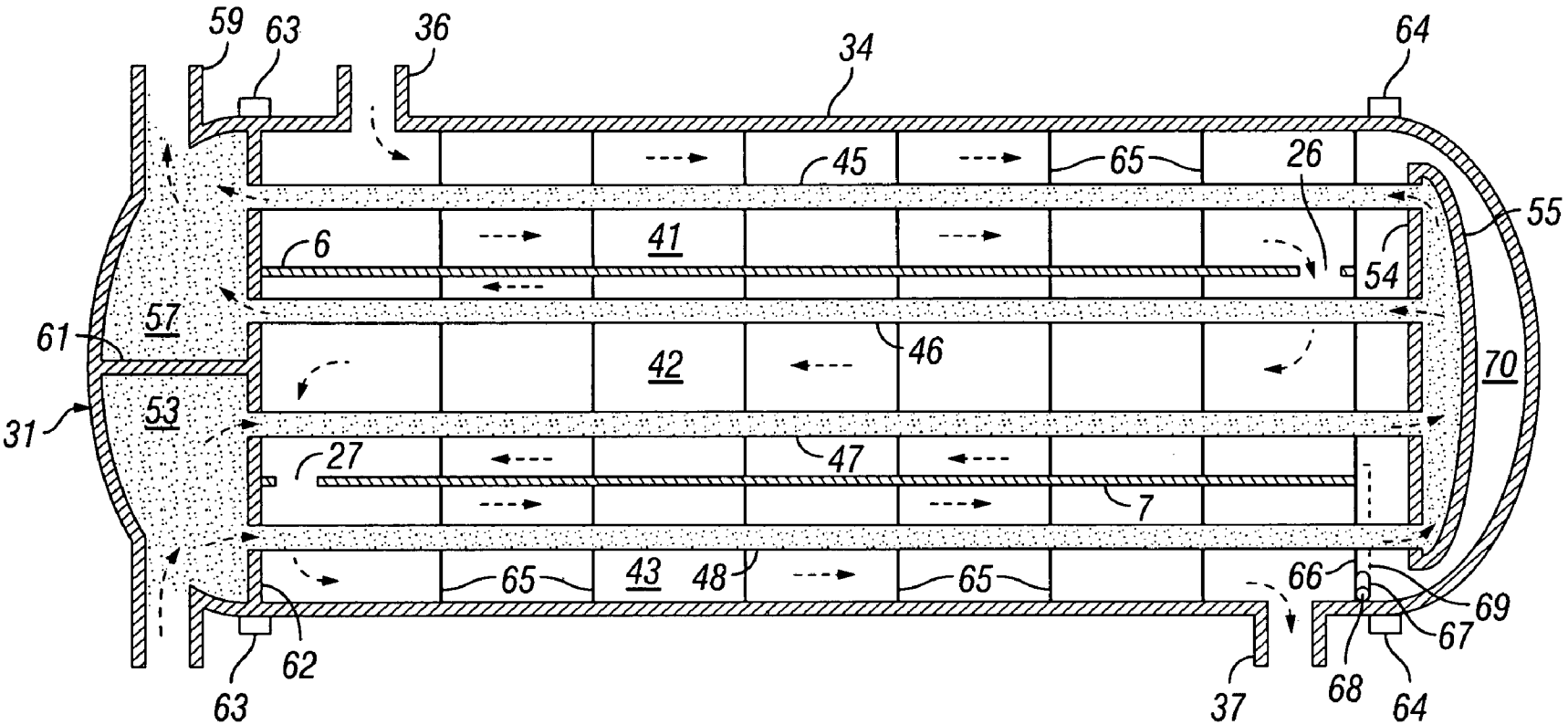
FIG. 2 shows schematically an assembly of baffles and seals according to the invention in a heat exchanger.

Reference is made to FIG. 2 showing schematically the assembly 1 mounted in a heat exchanger 31 with heat exchanger shell 34. The heat exchanger shell 34 has an inlet 36 at its upper side near one longitudinal end, and an outlet 37 at the lower side at the opposite longitudinal end. The longitudinal baffles have a width slightly smaller than the width of the shell at their mounting position so that the longitudinal outer rims of this plate are spaced slightly inwardly, typically 2-20 mm, from the inner wall surface of the shell. The longitudinal baffles partition the interior of the shell 34 into three compartments 41,42,43 which are in fluid communication via the cut-outs 26,27.

The heat exchanger is further provided with a tube bundle, only four tubes of which, tubes 45,46,47,48, are shown for the sake of clarity. The tube side of the heat exchanger 31 is indicated with dots. In this embodiment the tube side has a two-tube-pass arrangement. The tube side has an inlet 51 to a tube inlet header 53. The tube inlet header is in fluid communication with the lower part of the tube bundle, tubes 47,48, which extend to the tube end sheet 54 connected to the tubing end header 55 which in turn is in fluid communication with the upper part of the tube bundle, tubes 45,46, extending into the tube outlet header 57 where the outlet 59 from the tube side is arranged. The inlet and outlet tube heads 53,57 are separated by a horizontal plate 61 extending horizontally along in the centre of the shell 34 from the shell end to the tube sheet 62 in which the tubes are fixed. The tube sheet is secured to the shell by flanges 63, through which the inlet end of the shell can be opened for inserting of removing the internals. Flanges 64 through which the end part of the shell can be removed are also arranged at the rear end.

The tube end sheet 54 at the opposite end also fixes the tubes, but unlike the tube sheet 62 the tube end sheet 54 and the tube end header 55 to which it is connected are not connected to the shell 34, i.e. the end header is floating. This allows thermal extension of the tubes within the shell. Instead of an end header which receives and distributes all tube fluid also separate U-tubes could be applied.

The tubes are supported by a plurality of transverse baffles 65. The transverse baffle 66 that is farthest away from the tube inlet/outlet is different from the others. First of all, it is formed of a solid plate which is manufactured within tight tolerances to the cross-section of the shell, and is only provided with openings though which the tubes can just pass, but the tubes are not connected to this baffle plate. The end baffle 66 serves to prevent leaking of shell fluid from compartment 41 directly to compartment 43 by flowing around the tube header 55. By such leaking, shell fluid from the first pass would make a shortcut to directly reach the shell outlet 37, driven by the small pressure drop that exists between the different passes.

To prevent this, a seal in the form of profile 67 is arranged that presses packing material 68 against the shell 34, at least in the lower part of the circumference of the end baffle 66 to above the baffle 7, as indicated dashed at 69. By this seal, leaking from the free space 70 around the tube end header 55 into the third pass, compartment 43, is prevented. The seal can extend around the entire circumference of end baffle 67, but that is not strictly required as leaking into the second pass, compartment 43, is not a problem as it does not constitute a shortcut, like in two-shell pass heat exchangers. The transverse baffles are suitably interconnected for mechanical stability, e.g. by longitudinal rods (not shown).

Figure 3:
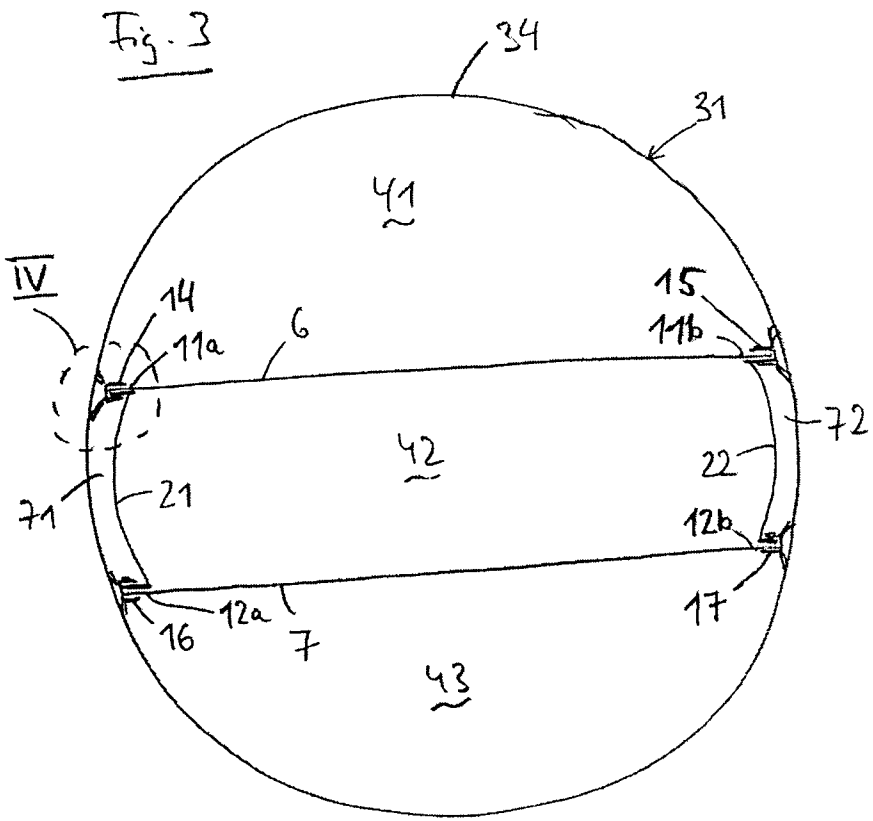
FIG. 3 shows schematically a cross section through the heat exchanger of FIG. 2.

FIG. 3 shows a cross-section of the heat exchanger shell with the mounted arrangement of baffles and seals along the line III-III in FIG. 2, but without tubes and transverse baffles. The double walls that are formed by the shell 34 and the wall members 21,22, defining inner spaces 71,72, is clearly visible. The shrouds 21,22 extend all the way from the tube sheet 62 to the end baffle plate 66, and are sealingly connected to these. To this end flanges (not shown) are welded to the ends of the shrouds 21,22 which are bolted, using suitable packing material, to the tube sheet and end baffle plate, respectively.

Figure 4:
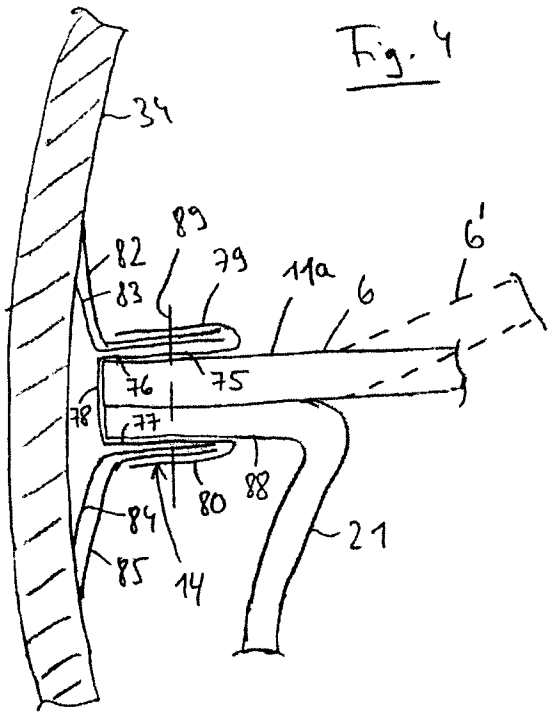
FIG. 4 shows schematically detail IV of FIG. 3 enlarged.

An embodiment of the longitudinal seal 14 is shown as enlarged portion IV in more detail in FIG. 4, and the other longitudinal seals 15,16,17, are analogously constructed.

The longitudinal seal 14 comprises a U-shaped flange 75 that is formed of inner flanges 76 and 77 connected via bottom flange 78, all made from one piece of strip metal. The strip metal is folded over to form folds 79 and 80. The folds are arranged to hold the wall sealing member in the form of elastic outwardly extending flanges, metal lamellae 82,83,84, 85. Four lamellae are shown in the drawing, two to either side, but more or less lamellae seals can be arranged. A typical number is 4 lamellae to either side.

The groove formed by the U-shaped profile 75 has a width such that the combined thickness of the longitudinal rim 11*a* of baffle 6 and of the folded rim 88 of wall member 21 are snugly received. If desired, packing material suitable for the operating temperatures such as Teflon can be applied. The parts can be bolted together along dashed line 89. It will be understood that clearances between parts in the drawing are shown exaggerated for the sake of clarity.

Figure 5:
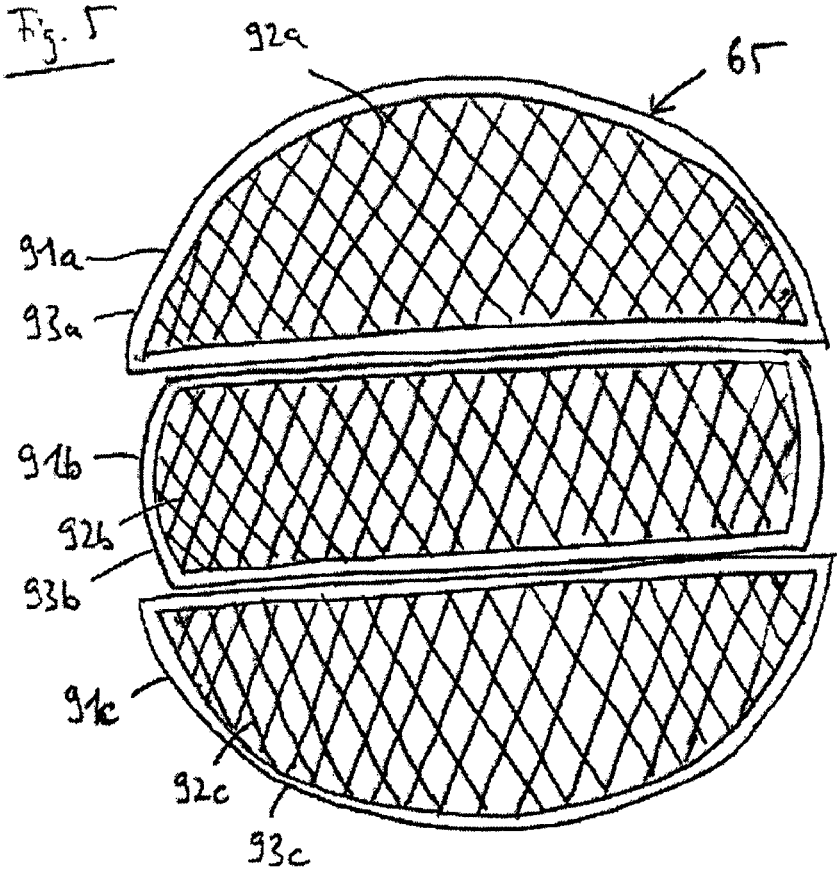
FIG. 5 shows schematically transverse expanded metal tube support baffles for use with the present invention.

FIG. 5 shows a transverse baffle 65 which is formed of 3 segments 91*a*,91*b*,91*c*, thereby being adapted to co-operate with the two longitudinal baffles 6,7 in a three-shell-pass heat exchanger. The segments of this embodiment are made of expanded metal sheets 92*a,b,c* that are cut to size and welded to a frame 93*a,b,c*, which frame can be connected to the shell and/or to the longitudinal baffles as needed for mechanical stability.

Figure 6:
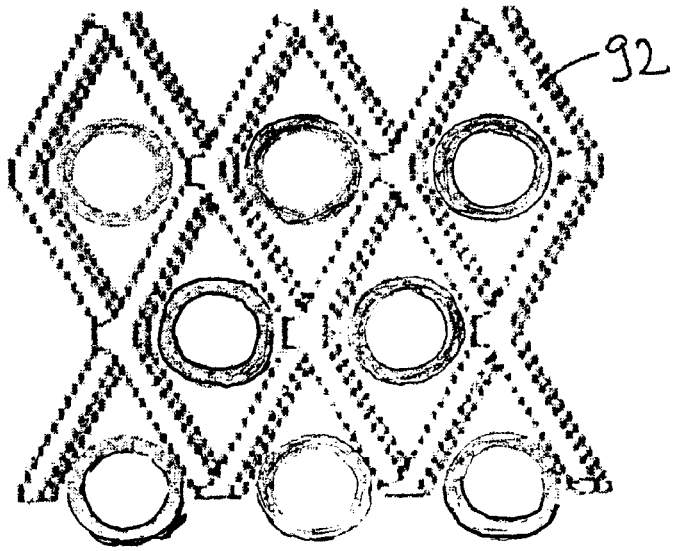
FIG. 6 shows schematically a bundle of tubes passing through expanded metal.

The expanded metal 92 supports the tubes as schematically shown in FIG. 6.

If the longitudinal baffle is placed relatively far away from a diameter of the shell, it can be advantageous to fold the longitudinal rims, such as indicated for dashed baffle 6' in FIG. 4, towards the radius of the shell 34.

For manufacturing a heat exchanger, a heat exchanger shell is provided, if needed after removing original internals. The assembly of baffles and seals according to the invention is preferably assembled outside the shell so that an arrangement of stacked longitudinal baffles provided with longitudinal seals at their longitudinal rims is obtained, wherein the wall members extend between longitudinal seals of adjacent longitudinal baffles. The assembly can be further completed with transverse baffles and tubes, and suitably with the tube sheet and tube end sheet, and the completed assembly can be slid into the shell. To this end the tube inlet/outlet header is removed, and suitably also the end part (flanges 63 and 64 in FIG. 2). The tube end sheet 54 has a smaller diameter than the tube sheet 62, since it has to pass through the shell. The tube header 55 is suitably mounted after the assembled arrangement has been moved through the shell. Suitably sliding strips are arranged on the circumference of transverse baffles.

An example of normal operation of a heat exchanger with internals according to the present invention will now be described. The heat exchanger of this example is used in a pre-heat train of a crude distilling unit, wherein a previous single-pass heat exchanger was revamped by installing an assembly as shown in FIGS. 2-6. The overall length of the tubes is ca. 6 meters, the inner diameter of the cylindrical shell is ca. 1.2 meters. The horizontal longitudinal baffles are symmetrically arranged with respect to a diameter of the shell, and form an angle of 18 degrees with the normal (i.e. a radius at the seal point) of the shell. It was found that in this case no folded longitudinal rim is needed when Kempchen T4 baffle seals are used, wherein the elastic lamellae seals are made from stainless steal 316 TI. The double wall formed an inner space of 50 mm width, cf. reference numeral 71 in FIG. 3. No tubes could be arranged along the horizontal centreline of the shell because of the horizontal plate 61 separating tube inlet and outlet headers. A total of 866 tubes was installed.

The fluid passing through the tube side is crude, which is pre-heated, say from 155° C. to 180° C., against hot long residue that is passed through the shell side and cooling from 270° C. to 220° C. Use of expanded metal baffles is particularly advantageous in this case as it reduces fouling and maintenance/cleaning cost in the shell side. The three-shell-pass design increases the flow velocity in the shell side which is beneficial for high duty heat transfer in a compact shell. It also makes good use of the available pressure drop. A particularity of the layout of this example with three shell passes and 2 tube passes is that the shell and tube flows are counter-current in compartment 41, partly counter-current and partly co-current in compartment 42, and co-current in compartment 43.

It shall be understood that the invention can likewise be used with more than two longitudinal baffles. For example, with 3 longitudinal baffles, suitably four wall members are provided so as to arrange four double walls, two between the first and second, and two between the second and third longitudinal baffle. The longitudinal seals of the second (middle) longitudinal baffle preferably hold the folded longitudinal rims of the two wall members that extend upwardly and downwardly from that seal. In such a four-shell pass design the shell inlet and outlet are normally at the same end of the shell. Since in such a design a longitudinal baffle runs along a horizontal diameter of the shell, there is no conflict with the horizontal separation plate between tube inlet/outlet header.

That which is claimed is:

1. An assembly of baffles and seals for mounting in a heat exchanger shell, which assembly comprises a plurality of longitudinal baffles each having two longitudinal rims;

a plurality of longitudinal seals for sealingly engaging the longitudinal rims of the longitudinal baffles against the heat exchanger shell after mounting; and a wall member having a folded longitudinal rim that is arranged to extend between longitudinal seals of adjacent longitudinal baffles so as to form a double wall with the heat exchanger shell after mounting, wherein each of said plurality of longitudinal seals is a two piece seal comprising a U-shaped flange and a wall sealing member, said wall sealing member being formed of oppositely outwardly extending elastic flanges, said U-shaped flange having folds into which said opposite outwardly extending elastic flanges are inserted and held, and wherein said U-shaped flange is arranged to also receive the folded longitudinal rim of the wall member extending from that longitudinal seal.

2. The assembly according to claim 1, wherein at least one of the longitudinal baffles has a folded longitudinal rim.

3. The assembly according to claim 2, wherein the assembly further comprises a plurality of transverse baffles for supporting a bundle of tubes.

4. The assembly according to claim 3, wherein the transverse baffles comprise elements of expanded metal.

5. The assembly according to claim 4, wherein the number of longitudinal baffles is n−1 to create a meandering fluid flow path of n passes between an inlet and an outlet of the heat exchanger shell, wherein n>2, and wherein the transverse baffles are formed of n segments.

6. The assembly according to claim 5, wherein the segments of transverse baffles between adjacent longitudinal baffles have a cross-section corresponding to the cross-section between opposing double walls of the adjacent longitudinal baffles.

7. The assembly according to claim 6, wherein tubes extend from a tube sheet through the transverse baffles and transverse end baffle to a tube end sheet, and wherein the wall member is connected at one end to the tube sheet and at the other end to the end baffle.

8. The assembly according to claim 7, wherein the end baffle is provided with a seal so as to prevent bypass of fluid between shell passes around the end baffle.

9. The assembly according to claim 8, wherein the assembly is arranged in the heat exchanger shell.

10. The assembly according to claim 1, wherein the oppositely outwardly extending elastic flanges inserted and held in the folds of said U-shaped flange comprise metal lamellae.

11. The assembly according to claim 10, wherein four metal lamellae are inserted into folds on either side of said U-shaped flange.

* * * * *